US005566523A

United States Patent [19]

Ozanne

[11] Patent Number: 5,566,523

[45] Date of Patent: Oct. 22, 1996

[54] WALL PANEL CONSTRUCTION

[76] Inventor: Leroy Ozanne, 15800 S. Woodland, Shaker Heights, Ohio 44120

[21] Appl. No.: 493,224

[22] Filed: Jun. 20, 1995

[51] Int. Cl.[6] ..... E04H 12/00

[52] U.S. Cl. ..... 52/655.1; 52/271; 52/489.2; 52/580; 52/592.1; 52/654.1; 52/779.14; 52/797.1

[58] Field of Search ..... 52/580, 474, 489.2, 52/483.1, 489.1, 653.1, 270, 271, 281, 690, 654.1, 655.1, 589.1, 592.1, 797.1, 799.14, 800.12

[56] References Cited

U.S. PATENT DOCUMENTS

| | | | |
|---|---|---|---|
| 1,951,346 | 3/1934 | Collins | 52/483.1 X |
| 2,818,608 | 1/1958 | Lawrence, III | 52/690 X |
| 3,008,195 | 11/1961 | Coffey | 52/690 X |
| 3,019,863 | 2/1962 | Kearns, Jr. | 52/489.1 X |
| 4,037,379 | 7/1977 | Ozanne | 52/580 X |
| 4,467,584 | 8/1984 | Crites et al. | 52/489.1 X |
| 4,817,355 | 4/1989 | Tisley et al. | 52/580 X |
| 5,152,113 | 10/1992 | Guddas | 52/281 X |
| 5,203,132 | 4/1993 | Smolik | 52/690 X |
| 5,313,752 | 5/1994 | Hatzinikolas | 52/690 X |
| 5,483,778 | 1/1996 | Scrivener | 52/580 X |

FOREIGN PATENT DOCUMENTS

| | | | |
|---|---|---|---|
| 321183 | 6/1989 | European Pat. Off. | 52/653.1 |
| 406212719 | 8/1994 | Japan | 52/474 |
| 649803 | 6/1985 | Switzerland | 52/474 |
| 894118 | 12/1981 | U.S.S.R. | 52/474 |
| 12300 | 7/1992 | WIPO | 52/653.1 |

*Primary Examiner*—Wynne E. Wood
*Assistant Examiner*—Aimee E. McTigue
*Attorney, Agent, or Firm*—Wodling, Krost & Rust

[57] ABSTRACT

A generally box-shaped wall panel construction includes a first pair of spaced and generally parallel side frame members each of which is of a generally channel or open shaped cross section with the open end facing in the first direction. Another pair of spaced and generally parallel side frame members form part of the construction and each is preferably of a box shaped cross section. The four side frame members constitute what might be referred to as generally a box shape when they are connected by first and second plates at the end of each side frame member. Specifically, the plates have four corners with the material of each corner being formed in the first and second tabs which facilitate spot welding of the ends of the side frame members to the plate with which it is associated. Another feature of the invention is the modification of tile plates so as to enable the wall panel construction to form a 90° corner and the wall panel construction is also modified so as to provide construction which readily accommodates the provision of providing a window opening or a door opening in a continuous wall made from the wall panel construction of the present invention.

24 Claims, 13 Drawing Sheets

WALL PANEL CONSTRUCTION

The present invention relates generally to the building industry and has to do with a wall panel construction that can be used to construct walls in original construction or rehabilitate presently existing construction which is in need of repair.

The present invention relates generally to the subject of the invention found in U.S. Pat. No. 4,037,379 issued Jul. 26, 1977 and entitled "Wall Panel." This patent issued on U.S. patent application Ser. No. 703,640 filed Jul. 8, 1976.

The present panel construction is in some respects similar to the '379 patent in that it includes preferably a welded steel construction but involves more components which results in a strong construction better connected and less susceptible to twisting or bending. The present invention includes a construction which is readily amenable to the incorporation of insulating material and is adapted to receive wallboard or other panel type constructions on respective sides of the wall panel. Also electrical component can be formed as part of the wall panel as it may be factory mass produced. It will be readily understood that in the present construction, while the preferred materials are of metal, they may be of other materials such as extruded plastic type materials which are relatively rigid in their construction so as to provide a suitable support.

The present construction can be factory mass produced by semi-skilled workers at substantial savings over present on the job erected structures. The preferred materials of construction also provide extremely good strength and provide resistance to weather conditions and attacks by other environmental factors.

The present invention offers a distinct advantage over the '379 construction that it is stronger and more resistant to bending or twisting or shearing type actions on the panel member per se.

In addition, the present invention provides for a construction which enables a corner of a building structure to be formed from the same components. Additionally the present invention provides that a window opening can be provided in the construction which is illustrated in the present drawings and the same structural components can be used to provide a door opening. The door opening has not been specifically shown in the drawings but which will be readily appreciated by those skilled in the art.

Other objects and a fuller understanding of this invention can be had by referring to the following description and claims, taken in conjunction with the accompanying drawings, in which:

Figure 1:
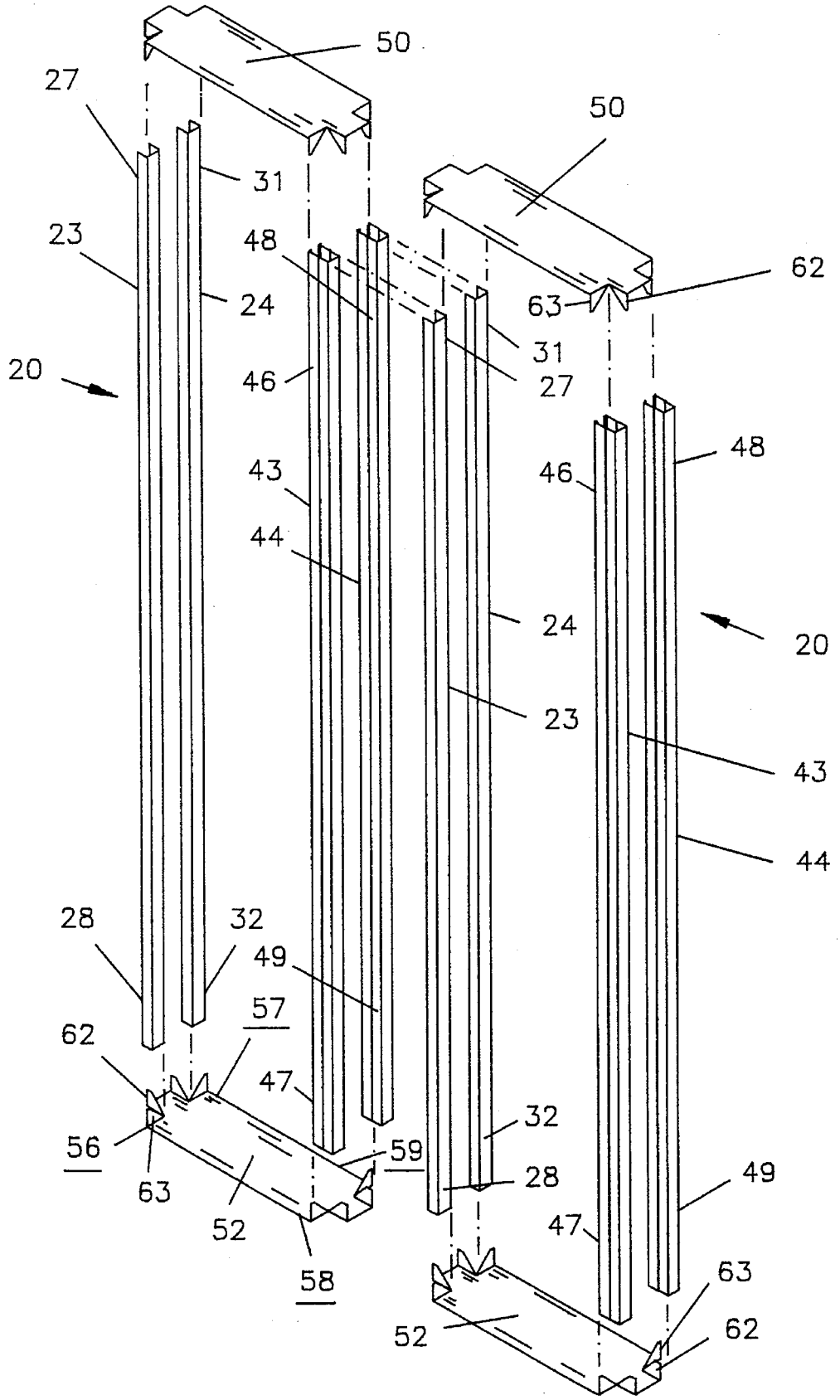
FIG. 1 is an exploded perspective view of the components of two wall panels constructed in accordance with the teachings of the present invention with the two wall panels not yet connected together.
Figure 2:
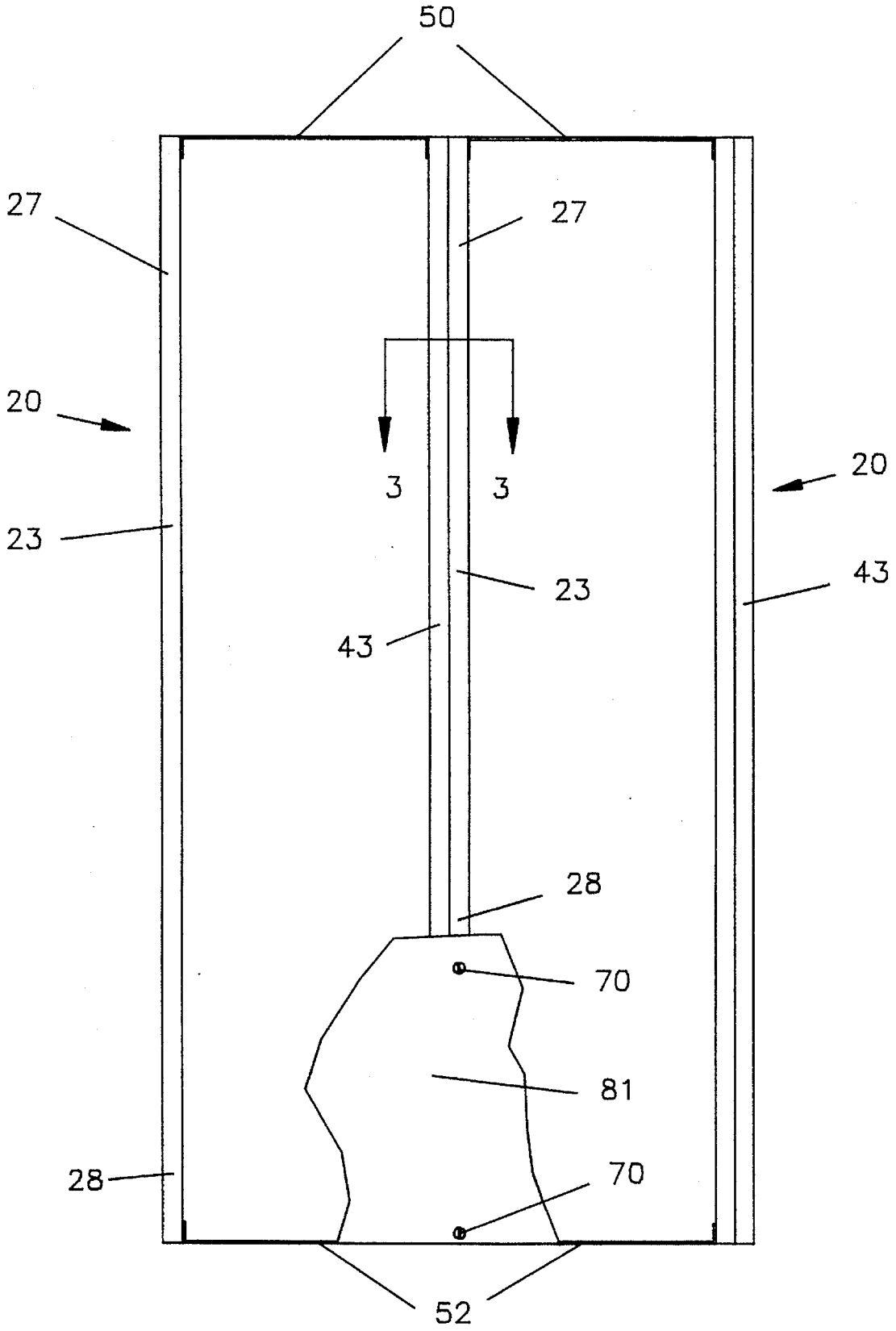
FIG. 2 is a front view of the two wall panels illustrated in FIG. 1 as pushed together and connected.
Figure 3:
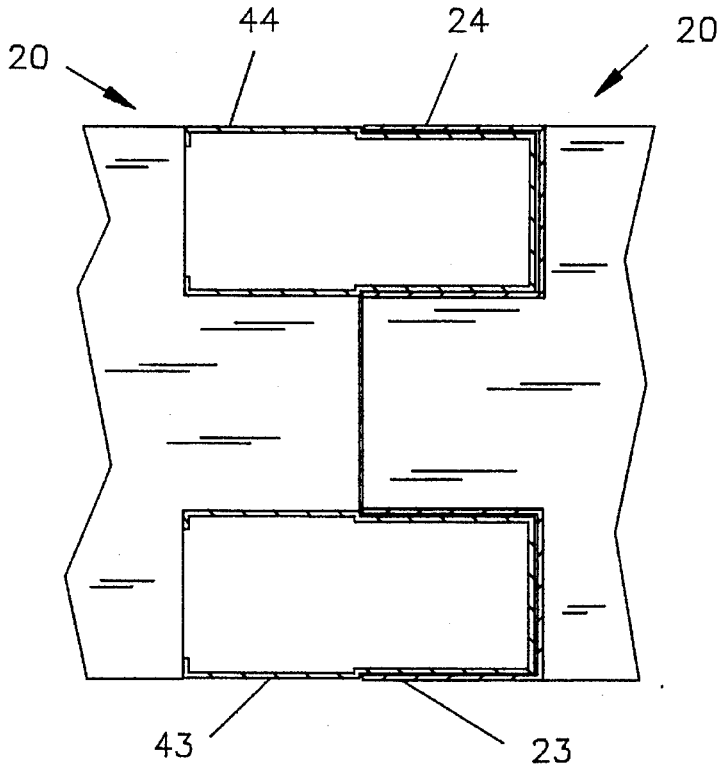
FIG. 3 is an enlarged fragmentary view taken generally along the line 3—3 of FIG. 2.
Figure 4:
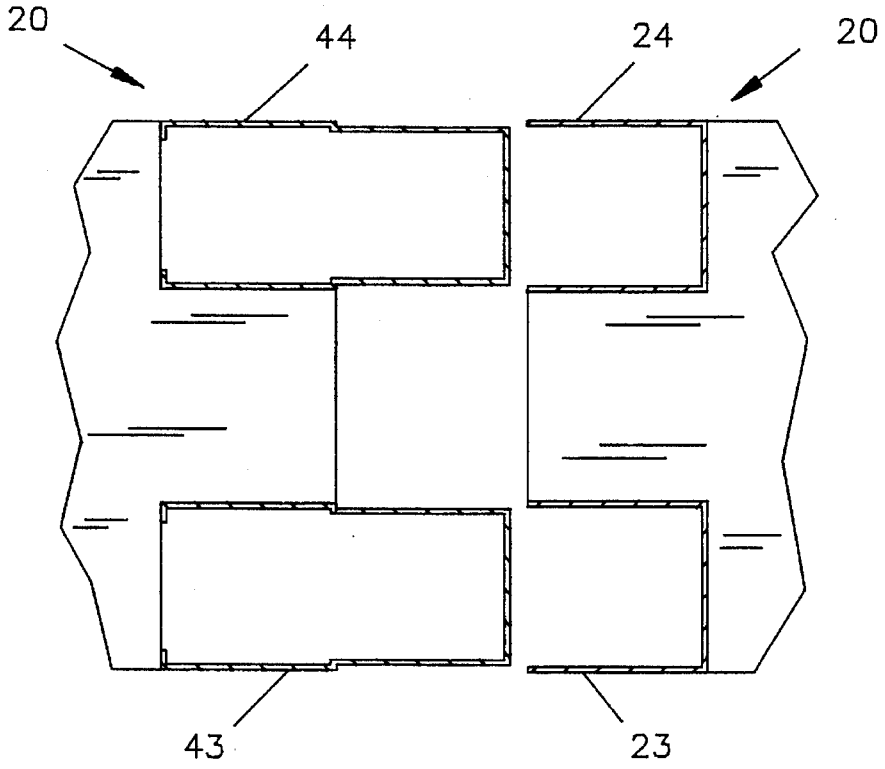
FIG. 4 is a view similar to FIG. 3 but illustrating the position of the two wall panels just before they are moved longitudinally to be connected together.

The teachings of the present invention are illustrated in all of the drawings; however, the initial understanding of the invention is best illustrated in FIGS. 1, 2, 3 and 4 of the drawings. As will be noted referring to FIG. 1, the wall panel of the present invention is illustrated generally by the reference numeral 20. It will be seen in FIG. 1 that two wall panels 20 have been illustrated and each has been shown in an exploded fashion With the two being arranged in respect to each other in a disconnected or not yet connected condition as also illustrated in FIG. 4. In order to connect the two wall panels 20 as illustrated in FIG. 1, they are simply moved longitudinally together as illustrated in the direction of the dot-dash lines in FIG. 1 to the condition illustrated in FIG. 3 and as seen in the elevational view of FIG. 2.

Each of the Wall panels 20 includes in combination a first pair of spaced and generally parallel side frame members and these side frame members have been identified by the reference numerals 23 and 24. The side frame member 23 has first and second end portions 27 and 28. The side frame member 24 is provided with first and second end portions 31 and 32, respectively. It will be seen that the side frame members 23 and 24 have generally a channel shaped cross-section sometimes referred to as an open end configuration which faces in a first direction as seen in the drawings.

A second pair of spaced and generally parallel side frame members 43 and 44 are provided which are also generally parallel to and spaced from the side frame members 23 and 24. The side frame members 43 and 44 have a generally box-shaped cross-section with a portion of the box shape facing in a second direction generally opposite from the first direction. The facing of the closed end of the box shape of the side frame members 43 and 44 is illustrated in various of the figures and particularly FIG. 1.

The side frame member 43 has first and second ends 46 and 47, respectively, and the side frame member 44 is provided with first and second end portions identified by the numerals 48 and 49, respectively.

First and second plates 50 and 52 are provided for each wall panel 20 and serve to secure the first and second end portions of the four side frame members in a fixed position with respect to each other to form what has been referred to above as a generally box-shaped construction. As will be described, the connection between the side frame members and the plates is preferably provided by spot welding; however, other suitable and readily appreciated means such as screws and bolts and the like might be utilized.

Each of the plates 50 and 52 has four corners which have been identified by the reference numerals 56, 57, 58 and 59. The metal of each corner of each of the side plates has been bent or otherwise formed to form first and second tabs 62 and 63 which are generally positioned at right angles to each other and which extend perpendicularly or normal from the material of the plate.

Figure 9A:
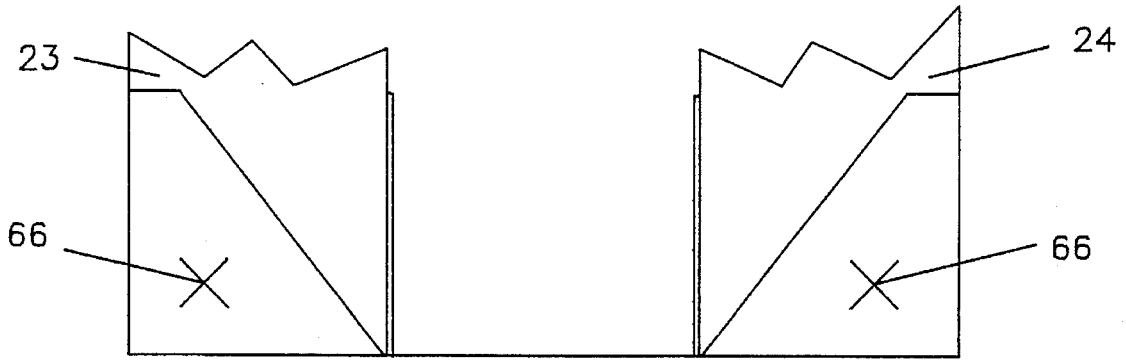
FIG. 9A illustrates a spot weld between the tabs and its respective side frame member.
Figure 10:
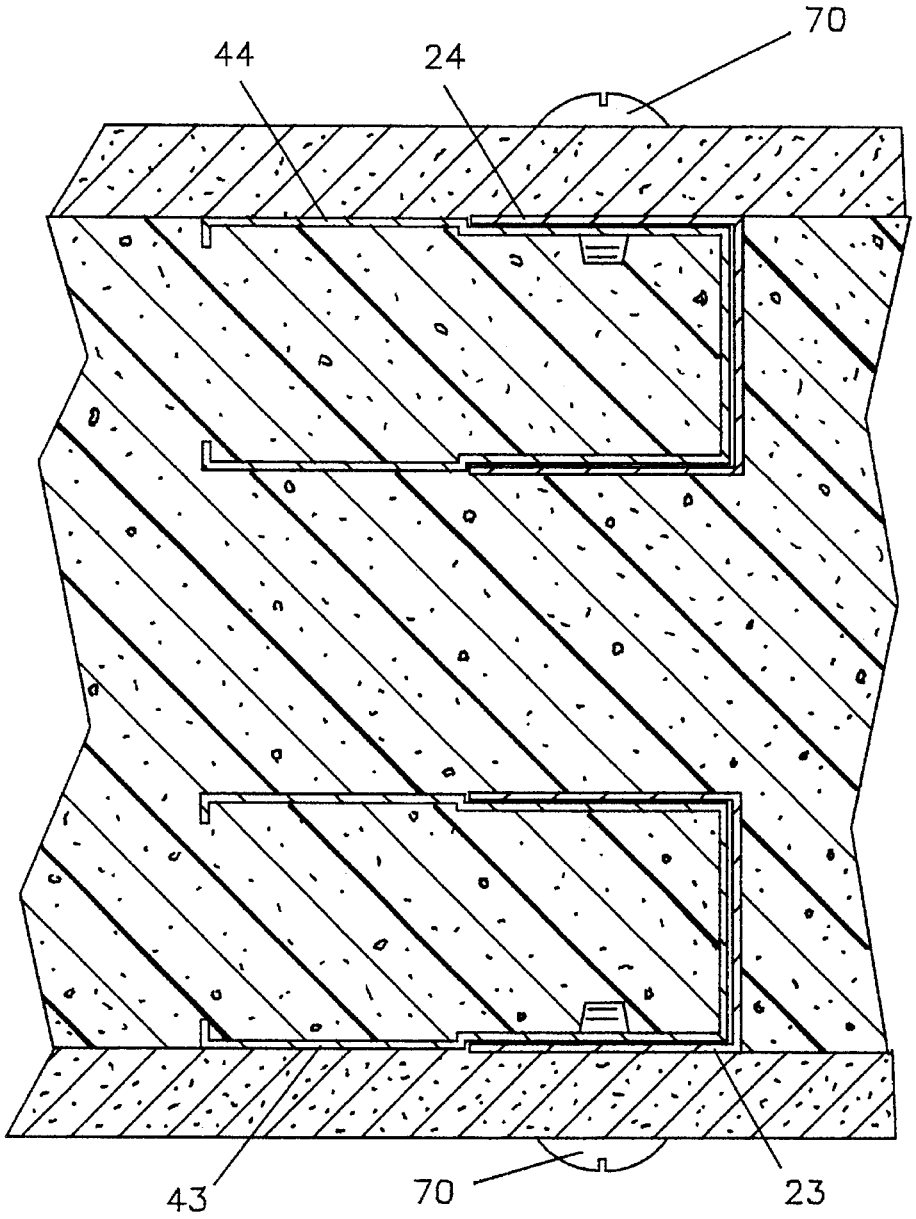
FIG. 10 is an enlarged fragmentary view taken generally along the line 10—10 of FIG. 9.

It will thus be seen that as each of the wall panels 20 illustrated in the exploded view of FIG. 1 are assembled, they each form a generally box-shaped construction with the side frame members of each being held in fixed and positive position relative to each other. Two identical panels 20 are assembled by moving the two panels together from the disconnected position of FIG. 4 into the connected position of FIG. 3. An elevational view of the connection of two panels 20 is seen in FIG. 2. In order to positively insure the connection after the two panel members have been:connected as illustrated in FIG. 3, it is sometimes advisable to utilize a threaded member 70 between the connected and mating side frame members 23 and 24 and 43 and 44. In FIGS. 2 and 10 wallboard 81 is also secured to both sides of the panel by the threaded members 70. The connection of the plates 50 and 52 to the side frame members 23, 24, 43 and 44 is best illustrated in FIG. 9A which shows a spot weld between one of the tabs 62 and 63 and its respective side frame member. The spot weld is illustrated by the reference numeral 66.

Figure 9:
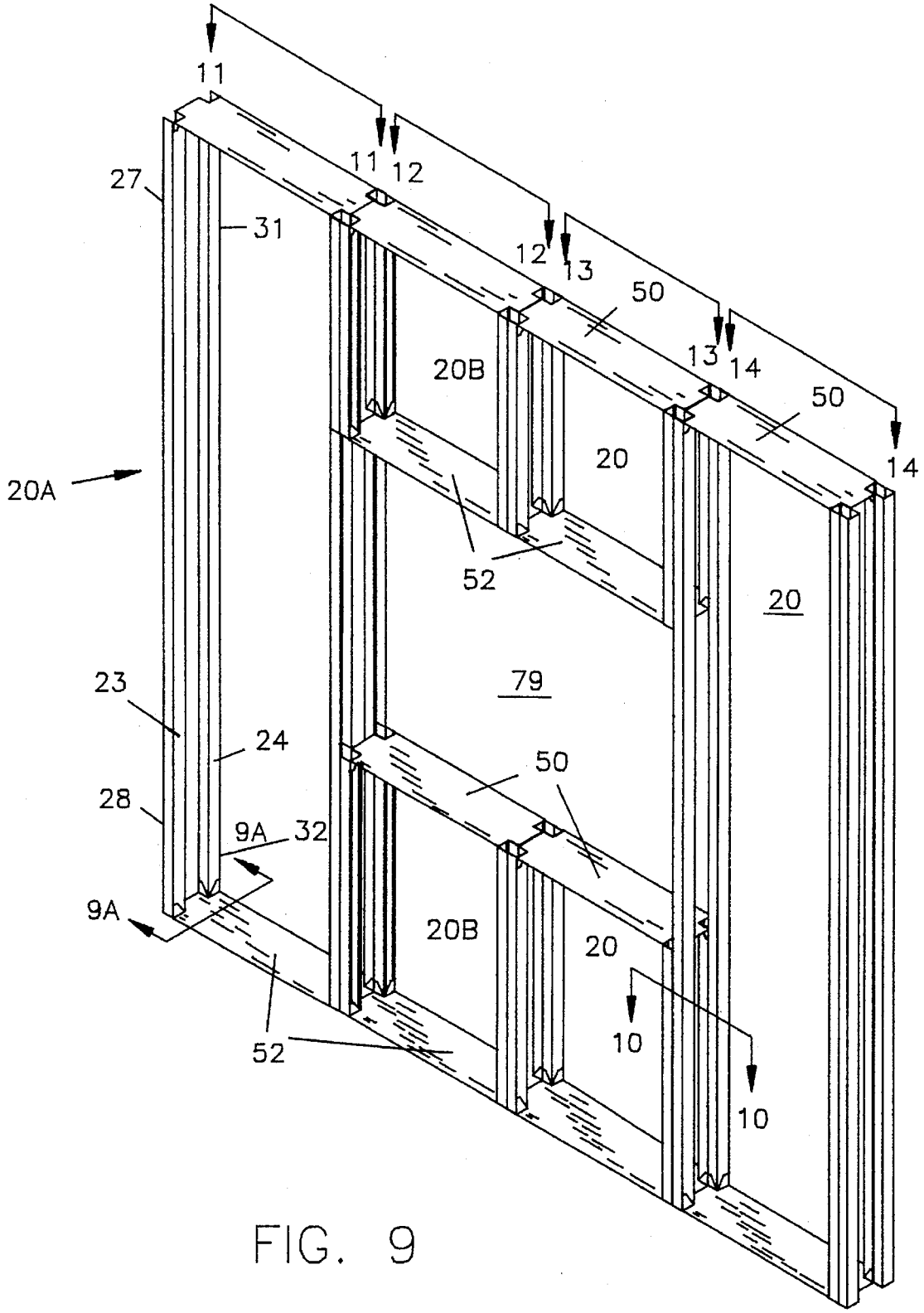
FIG. 9 is a perspective view illustrating use of the wall panels of the present invention in constructing an opening for the reception of a window in a wall construction.

It will thus be seen as illustrated for example in FIG. 9 that the respective ends of the side frame members are adjacent and contiguous to the tabs 62 and 63 at each of the four corners of each plate and are each spot welded at this point to hold the components of the wall panel in a fixed and rigid position relative to each other.

Figure 1A:
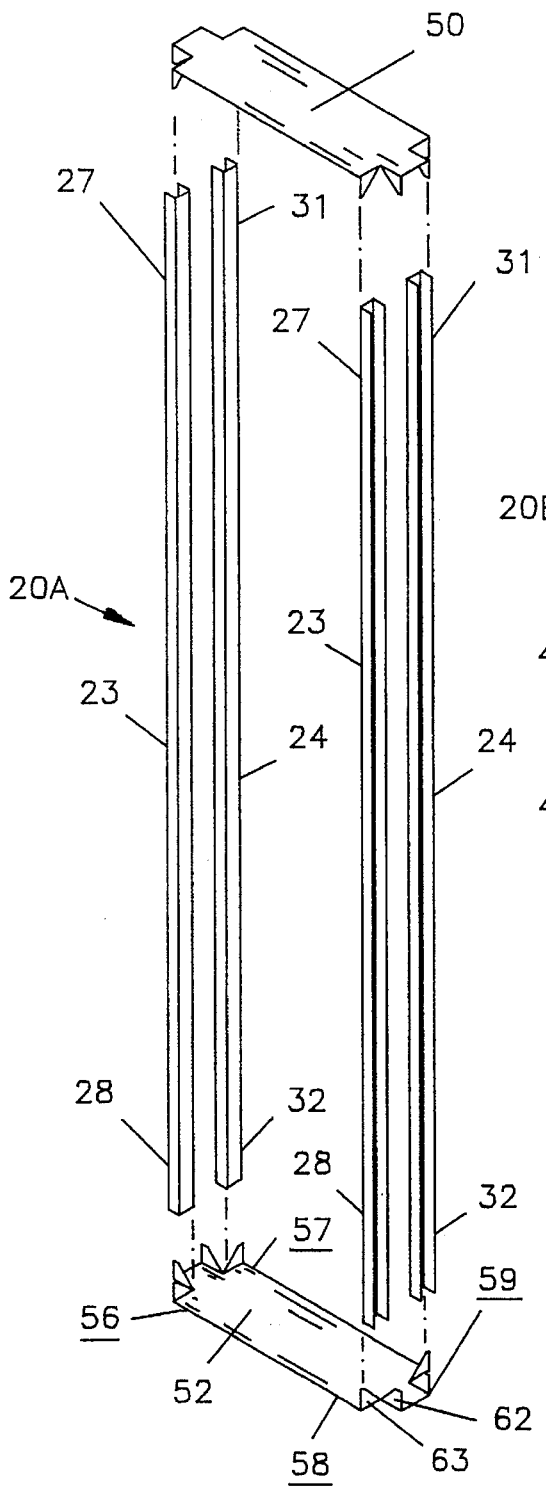
FIG. 1A is an exploded perspective view of a modification of the wall panel illustrated in FIG. 1.
Figure 1B:
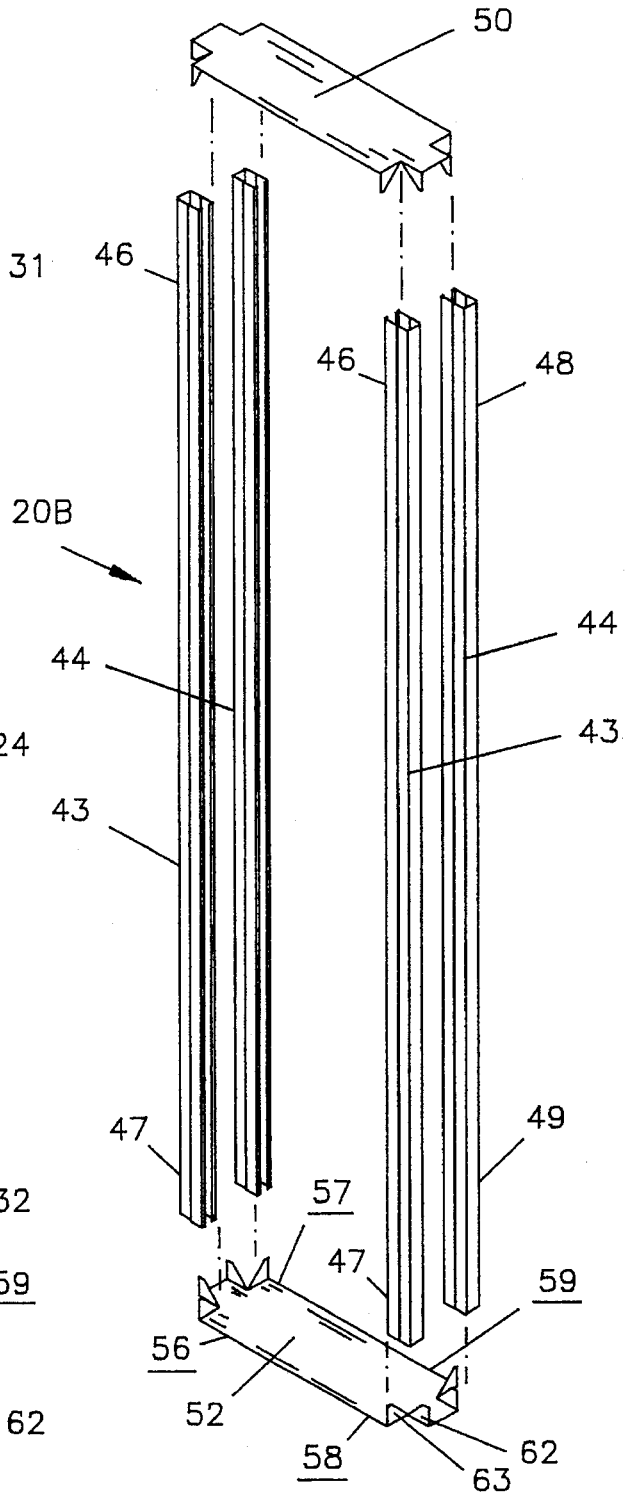
FIG. 1B is a still further modified version of the wall panel as illustrated in FIGS. 1 and 1A.

FIGS. 1A and 1B are quite similar to the illustration found in FIG. 1 with some slight differences. It will be noted that in FIG. 1A that the four side frame members are made up of two side frame members 23 and two side members 24 which are each of the open channel shaped cross-section and these open channels in this construction face in opposite directions. In all other respects, the construction is the same as the wall panels of FIG. 1 and the use of this construction will be described hereinafter in connection with a showing of the use of the invention as illustrated in FIGS. 9–14. The showing in FIGS. 9–14 is to illustrate how the wall panels can be utilized and modified to accommodate a window opening as specifically shown and in principle can be used to accommodate a door opening which has not been specifically shown.

FIG. 1B is similar to FIG. 1A except that the four side frame members are comprised of two side frame members 43 and two side frame members 44, both of the closed box-shape construction as illustrated in the embodiment of FIG. 1. The side frame members in FIG.1B are connected in the same fashion as discussed and illustrated in FIG. 1A and again FIG. 1B will be discussed hereinafter in accommodating a construction as illustrated in FIGS. 9–14.

Figure 5:
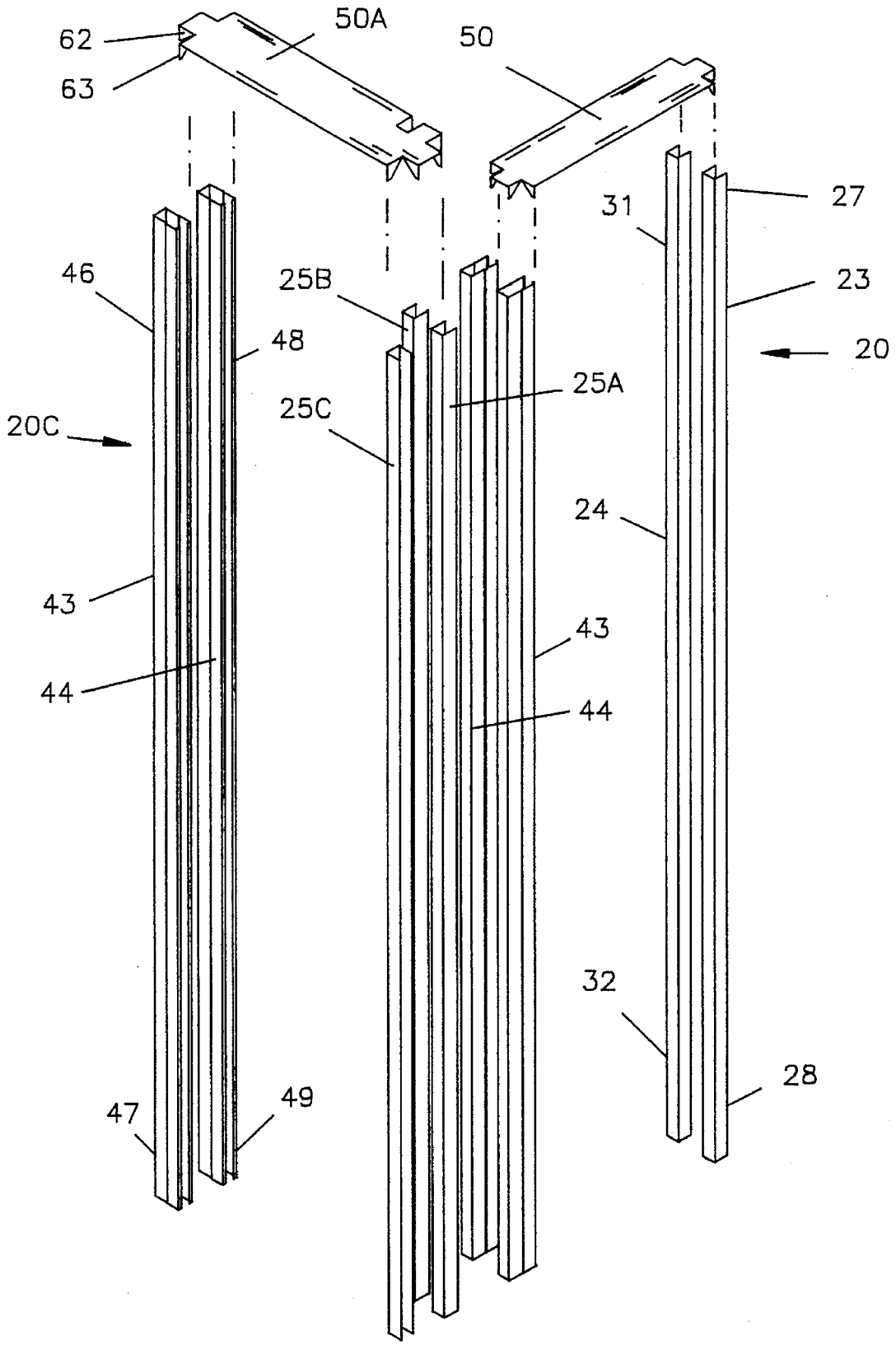
FIG. 5 is an exploded perspective view of the wall panel of the present invention adapted to provide a building construction which has a 90° corner. The connecting plates at the bottom of these two illustrated panel constructions has not been illustrated but is identical to the construction shown at the top.
Figure 6:
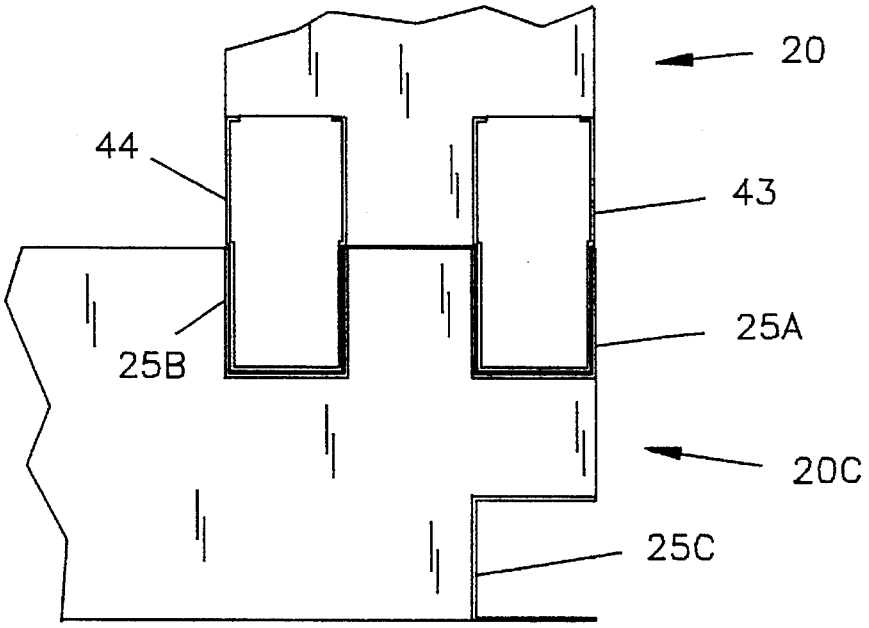
FIG. 6 is a plan view of the wall panels illustrated in FIG. 5 as connected together.
Figure 7:
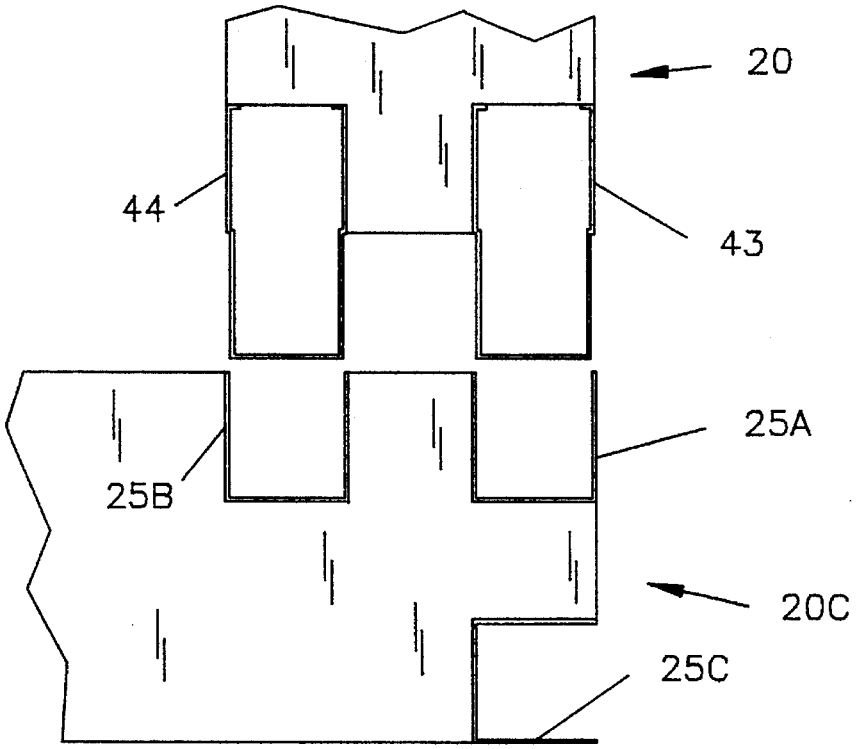
FIG. 7 is a view similar to FIG. 6 but illustrating the, wall panels just prior to being connected together.
Figure 8A:
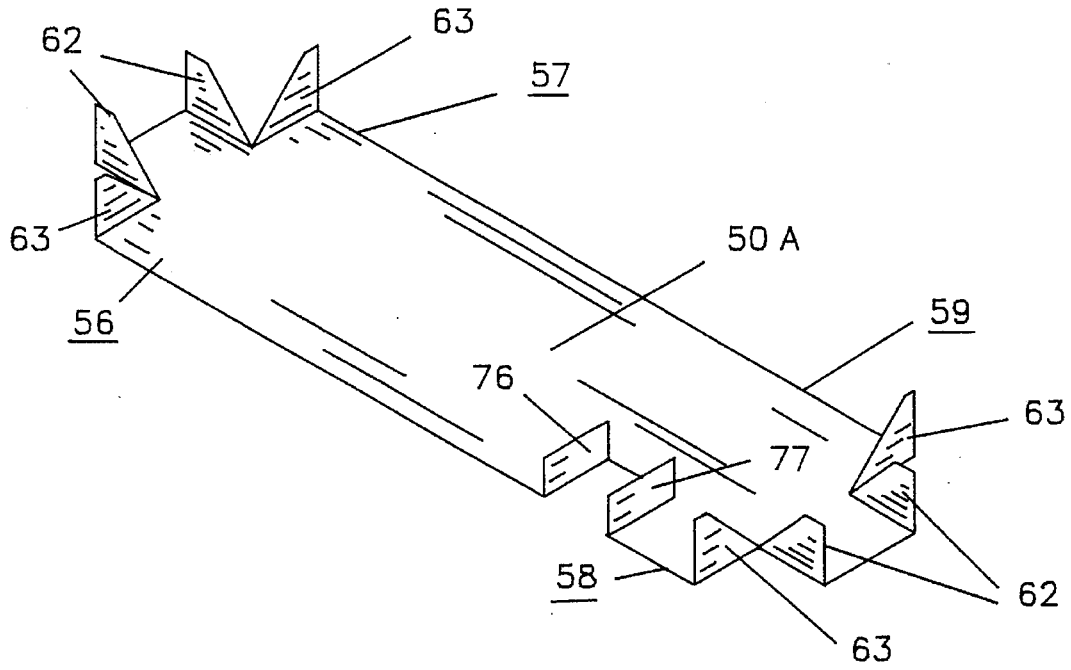
FIG. 8A is a view of the plate shown in FIG. 5 used to connect the support members of 20C.
Figure 8:
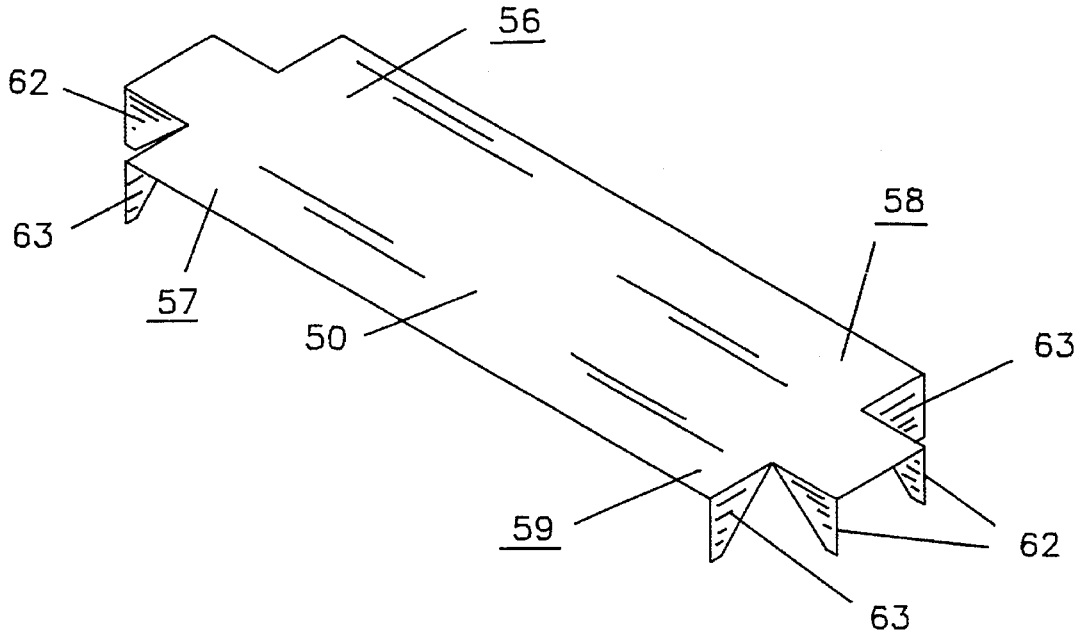
FIG. 8 is an enlarged perspective view of the plate that is utilized in connecting the longitudinally extending support members together as illustrated in FIGS. 1, 1A and 1B.

FIGS. 5 through 7 illustrate the use of the teachings of the present invention in the construction and use of two panels to form a 90° corner in a building construction. FIG. 5 illustrates a panel 20 as illustrated in FIG. 1 and a modification of the panel 20 which has been identified as 20C. In this embodiment or illustration, the two panels 20 and 20C have not been totally illustrated and have been shown in perspective and exploded condition. The incomplete portion is that the connecting plates illustrated at the upper portion of the view have not, been replicated at the bottom of the side frame members but identical plates are provided at the bottoms of the all the side frame members to hold them in position relative to each other. In this embodiment and showing, the wall panel 20 will not be further described and the wall panel 20C will be described only insofar as is necessary for an understanding as to how it varies from wall panel 20. It will be seen in FIG. 5 that wall panel 20C includes first and second side frame members 43 and 44 which have corresponding first and second end portions and these are connected to a first plate 50A (FIG. 8A) at the top thereof and obviously would be connected at the bottom by another plate 50A which has not been illustrated. In wall panel 20C there are provided three side frame members identified as 25A, 25B and 25C which are essentially the same as side frame members 23 and 24 but since they are slightly different in location, they have been given a new identification. The plate 50A is identical plate 50 with the exception that additional tabs 76 and 77 are formed from the material of the plate in a fashion similar that by which the tabs 62 and 63 are formed. The tabs 76 and 77 are adapted to be located adjacent the end portion of side flame member 25B which is spot welded to the tabs to hold it in fixed position.

The relative positions of wall panels 20 and 20C with respect to each other prior to being connected is illustrated in FIG. 7 which is generally a plan view of FIG. 5 and in the connected position the wall panels 20 and 20C are illustrated in FIG. 6. In like fashion, screws are utilized to accommodate an additional mechanical connection as a means of holding the side frame members 43 and 44 to side frame members 25A and 25B as generally illustrated in FIG. 10.

FIGS. 9–14 illustrate the teachings of the present invention in producing a wall construction which accommodates a window opening in a continuous wall. In this regard, panels as constructed in FIG. 1, 1A and 1B have been utilized to provide the window opening and the same philosophy and/or theory is utilized if one desires to construct a door opening.

Figure 11:
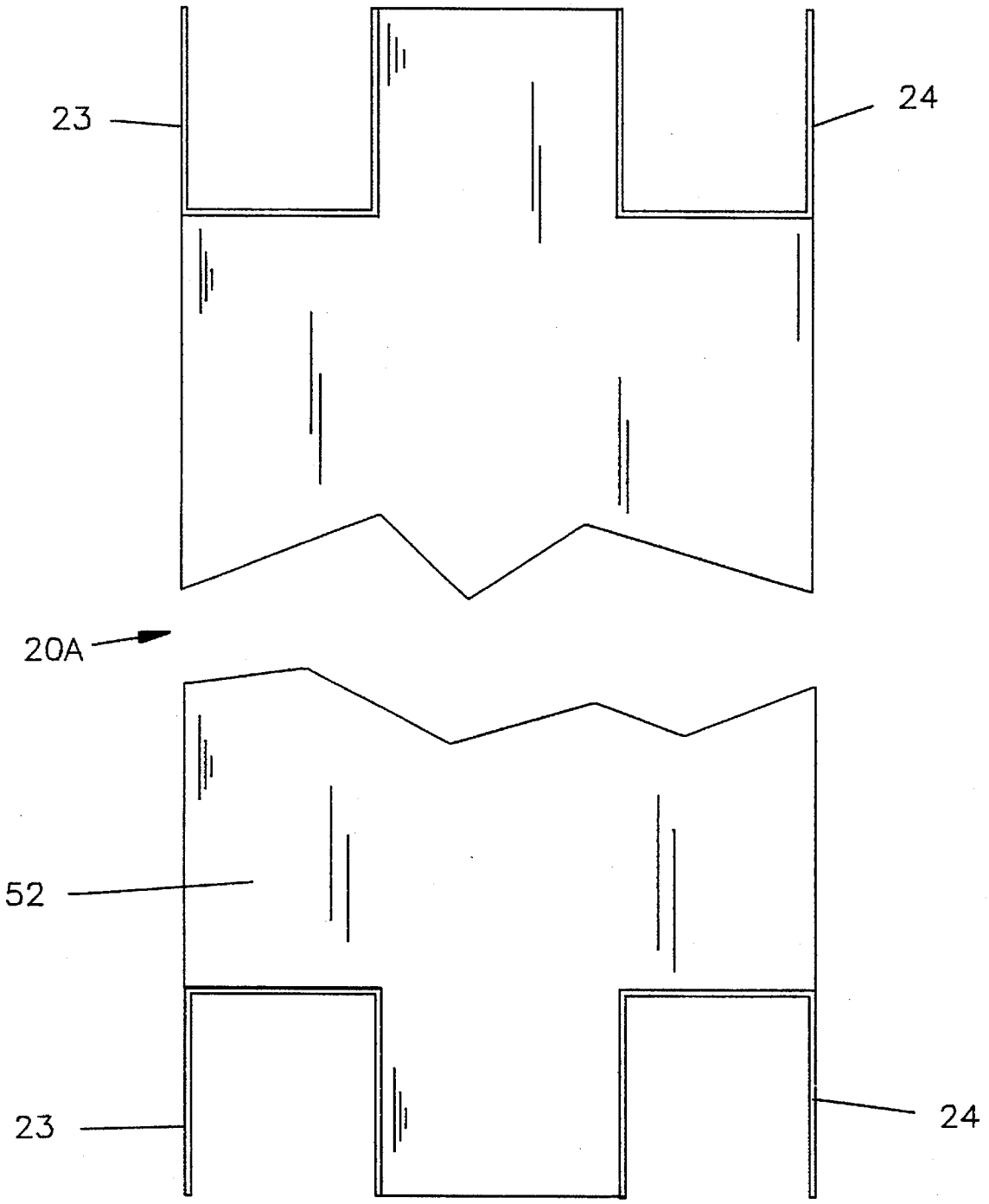
FIG. 11 is an enlarged fragmentary view taken generally along the line 11—11 of FIG. 9.
Figure 12:
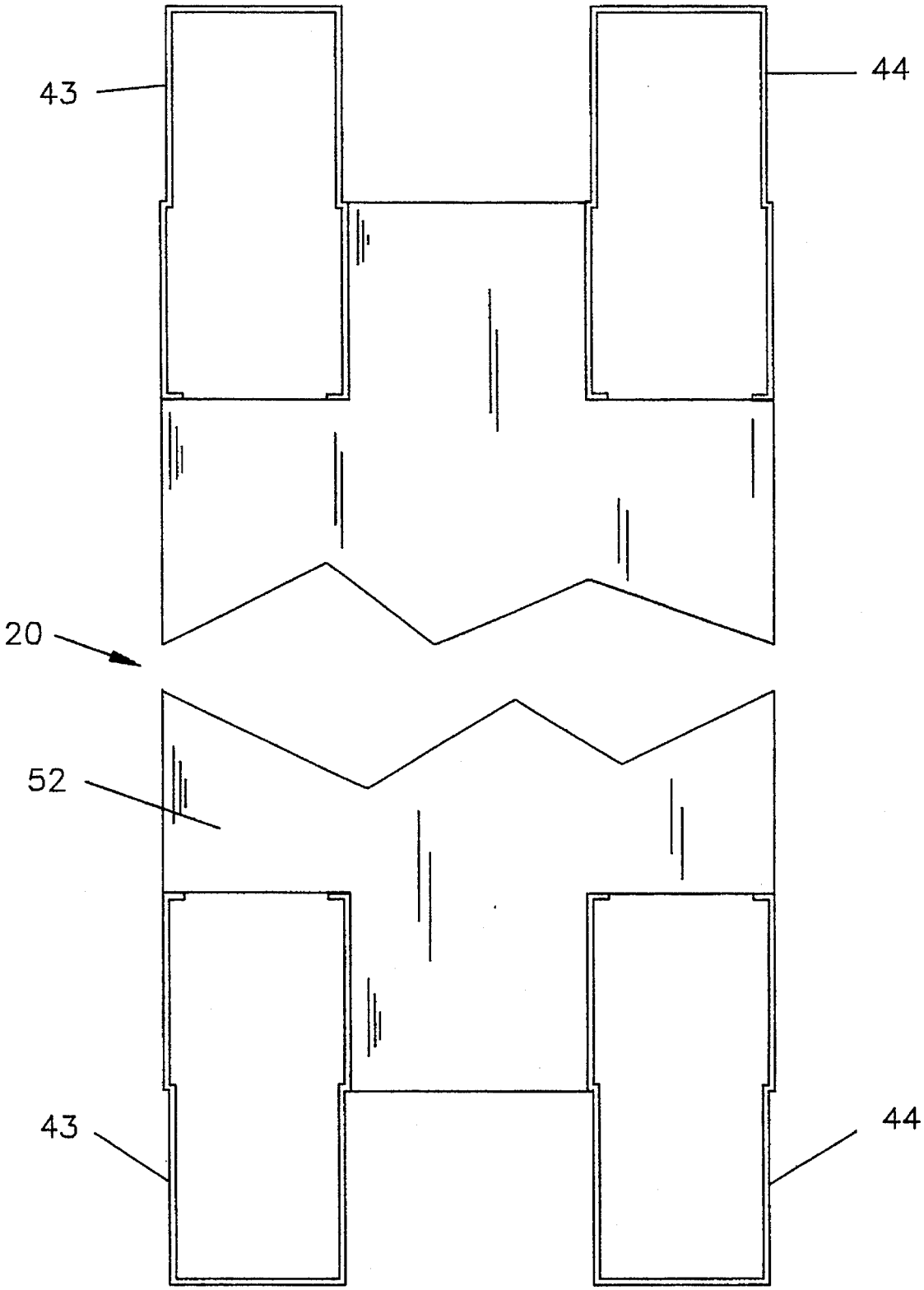
FIG. 12 is an enlarged fragmentary view taken generally along the line 12—12 of FIG. 9.

Referring specifically to FIG. 9 and viewing the wall construction with a window opening 79, it will be noted the left most panel is as illustrated in FIG. 1A, namely a panel member 20A. This panel member is illustrated as an eight foot high and two foot wide construction. This panel member is illustrated in FIG. 11 which is taken generally along the line 11—11 in FIG. 9. The next and Connecting panels are 20B as seen in FIG. 1B and illustrated in FIG. 12. It will be seen that panels 20B are vertically foreshortened as contrasted to the eight foot length illustrated in FIG. 1B but this is simply to accommodate the windows opening 79. As seen in FIG. 9, it will be apparent that the female side frame members 23 and 24 (FIG. 11) are positioned to accommodate the reception of the side frame members 43 and 44 (FIG. 12).

Figure 13:
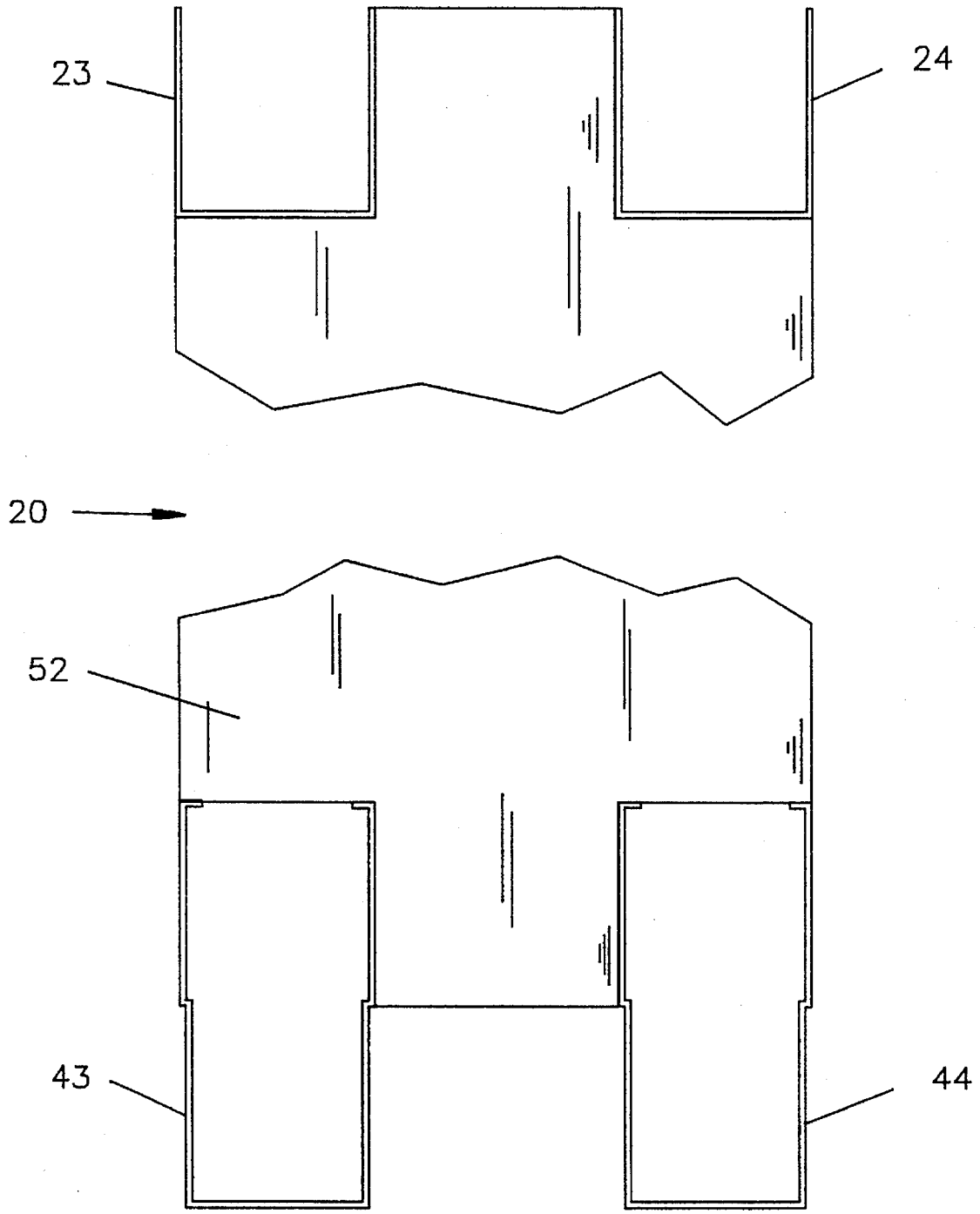
FIG. 13 is an enlarged view taken generally along the line 13—13 of FIG. 9.
Figure 14:
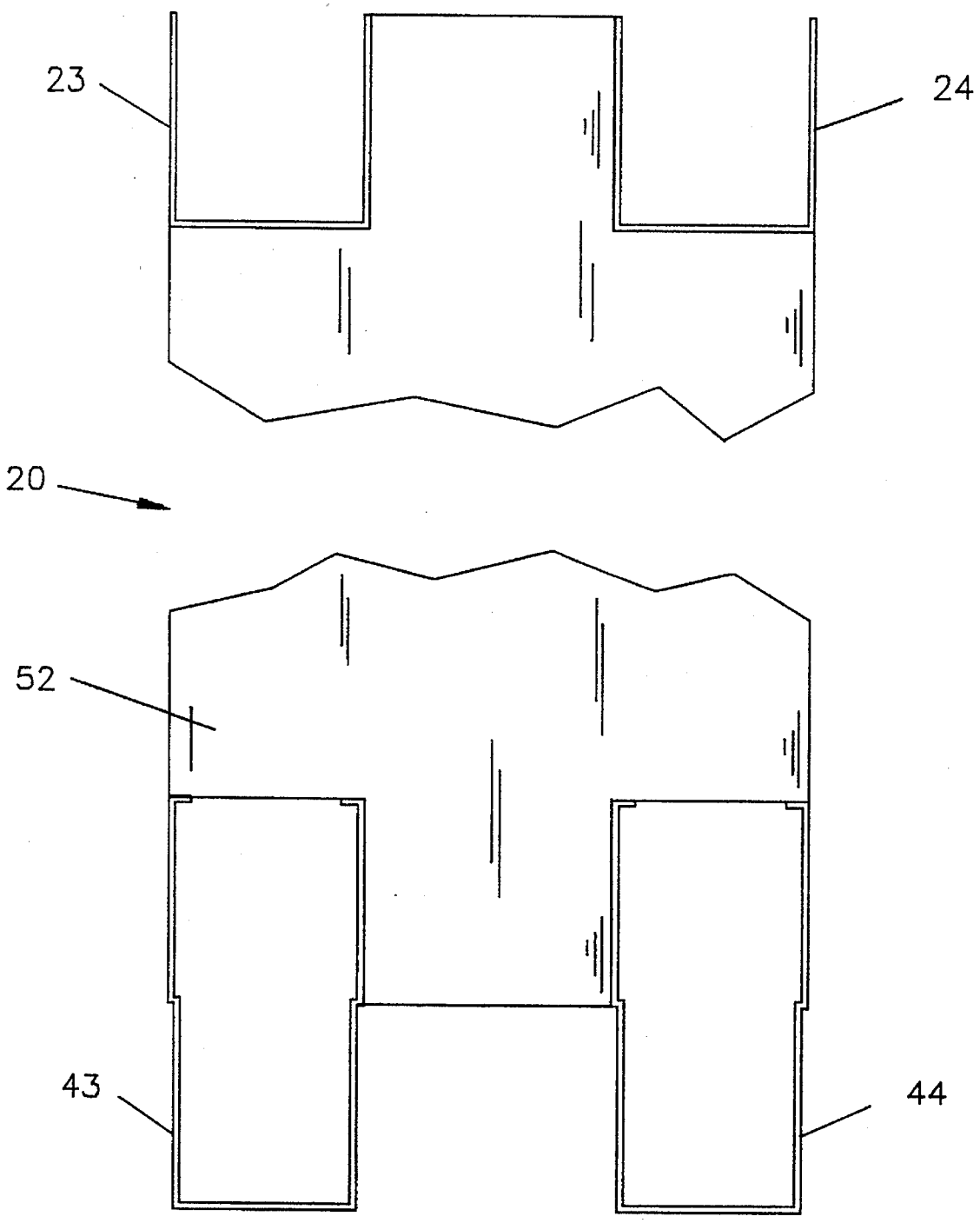
FIG. 14 is an enlarged view taken generally along the line 14—14 of FIG. 9.

The next wall panel moving to the right as viewed in FIG. 9 are wall panels 20 which are of the construction illustrated in FIG. 1 of the drawings; however, these wall panels have been foreshortened in their vertical height direction to accommodate the window opening 79. This construction is illustrated in plan view in FIG. 13 which is a view taken generally along the line 13—13 of FIG. 9. In this particular instance the male type side frame members 43 and 44 (FIG. 12) are adapted to be received into the side frame members 23 and 24 of panel 20 (FIG. 13). In like fashion, the next and last panel moving to the right is a wall panel 20 and this is illustrated in FIG. 14 which is a view taken generally along the line 14—14 of FIG. 9. It will be appreciated that to provide a door construction or an opening for a door all that is necessary in point of theory is to remove the lower two foreshortened wall panels 20B and 20 as illustrated FIG. 9 and a door opening is provided. If it is necessary to provide a door of a greater height then the upper foreshortened wall panels 20B and 20 can be either eliminated totally or may be foreshortened to have an even smaller vertical extent.

The size of the panels as illustrated in FIGS. 1, 1A and 1B is preferably on the order of two feet in width by eight feet in height and a depth or thickness of either 3 5/8 inches or 5 5/8 inches.

It will thus be seen that a wall panel has been disclosed which may be referred to as a double tongue and groove construction which results in greater structural integrity in the sense that it is much more difficult to twist or otherwise distort. It is also possible with what may be referred to as the four legged wall panel connected together at the opposite ends of the legs to provide a width within which can be provided insulation of any known type such as polystyrene and polypropylene or the entire space can be left as a void thereby providing an air barrier. It will be appreciated that in most cases the wall panels are covered on either side by either plasterboard or the like or they may be provided with wallboard on the inside and shingles or siding on the outside.

The invention has been described in detail with particular emphasis on the preferred embodiments thereof, but it should be understood that variations and modifications within the spirit and scope of the invention may occur to those skilled in the art to which the invention pertains.

What is claimed is:

1. A generally box shaped wall panel construction including in combination a first pair of spaced and generally parallel side frame members each having first and second end portions, each of said side frame members of said first pair having a generally channel shaped cross section, said frame members having three sides and one open end, said open end of each channel shape facing in a first direction, a second pair of spaced and generally parallel side frame members each having first and second end portions, each of said side frame members of said second pair having a generally box-shaped cross section with a portion of the box-shape facing in a second direction opposite said first direction, first and second plates respectively connecting said first and second end portions of said first and second pair of said side frame members in a fixed position with respect to each other, each said plate having four corners, of each corner being formed into first and second tabs extending generally normal to the plate and generally at a right angle to each other, an end portion of each side frame member residing adjacent said first and second tabs of a corner of a plate, and an affixing means connecting said tab to said end portion of said side frame member to fixedly secure the same together.

2. A wall panel as claimed in claim 1 wherein said affixing means connecting said tabs to said side frame members comprises welding.

3. A wall panel as claimed in claim 1 wherein at least one other wall panel is assembled thereto by inserting the box shaped cross section of said second pair of side frame members into the channel Shape of said first pair of said frame members.

4. A wall panel as claimed in claim 3 wherein screws are used to hold the two panels together.

5. A wall panel as claimed in claim 1 further including covering members, said covering members are applied to said pairs of frame members.

6. A wall panel as claimed in claims 5 wherein insulation is provided between said covering members.

7. A wall panel as claimed in claims 1 wherein said plates include additional first and second tabs, one of said side frame members extending between and connected to the first and second tabs of said plates to enable the wall panel to form a corner when two wall panels are combined.

8. A wall panel as claimed in claim 1 wherein the second pair of side frame members having a generally box-shaped cross section has one side which is substantially open to receive windows or doors.

9. A wall panel construction including in combination a first pair of spaced and generally parallel side frame members each having first and second end portions, each of said side frame members of said first pair having a generally channel shaped cross section, said frame members having three sides and one open end, said open end of each channel shape facing in a first direction, a second pair of spaced and generally parallel side frame members each having first and second end portions, each of said side frame members of said second pair having a generally box-shaped cross section with a portion of the box-shape facing in a second direction opposite said first direction, first and second plates respectively connecting said first and second end portions of said first and second pair of said side frame members in fixed position with respect to each other, each said plate having four corners, each corner being formed into first and second tabs extending generally normal to the plate and generally at a right angle to each other, an end portion of each side frame member residing adjacent said first and second tabs of a corner of a plate, and an affixing means connecting said tab to said end portion of sa side frame member to fixedly secure the same together, said open end of each channel shape of said side frame members of said first pair of a given panel construction adapted to receive box shape of said side frame members of said second pair of another panel construction so as to hold the two panel constructions together.

10. A wall panel as claimed in claim 9 wherein said side frame members are connected to said plates by welding.

11. A wall panel as claimed in claim 9 wherein at least one other wall panel is assembled thereto by inserting the box shaped cross section of said second pair of side frame members into the channel shape of said first pair of said frame members.

12. A wall panel as claimed in claim 11 wherein screws are used to hold the two panels together.

13. A wall panel as claimed in claim 9 further including a covering member, said covering member is generally parallel to and extends from said first pair of frame members to said second pair of frame members.

14. A wall panel as claimed in claim 13 wherein insulation is provided between said covering members.

15. A wall panel as claimed in claim 9 wherein the second pair of side frame members having a generally box-shaped cross section has one side which is substantially open to receive windows or doors.

16. A wall panel construction including in combination a first pair of spaced and generally parallel side frame members each having first and second end portions, each of said side frame members of said first pair having a generally open end configuration facing in a first direction, a second pair of spaced and generally parallel side frame members each having first and second end portions, each of said side frame member of said second pair having a generally closed end configuration facing in a second direction opposite said first direction, first and second plates respectively connecting said first and second end portions of said first and second pair of said side frame members in fixed position with respect to each other, said open end of each channel shape of said frame members of said first pair of a given panel construction adapted to receive the box shape of said side frame members of said second pair of another panel construction so as to hold the two panel constructions together.

17. A wall panel as claimed in claim 16 wherein said side frame members are connected to said plates by welding.

18. A wall panel as claimed in claim 16 wherein at least one other wall panel is assembled thereto by inserting the closed end configuration of said second pair of side frame members into the open end configuration of said first pair of said frame members.

19. A wall panel as claimed in claim 18 wherein screws are used to hold the two panels together.

20. A wall panel as claimed in claim 16 further including covering members, said covering members are applied to said pairs of frame members.

21. A wall panel as claimed in claim 20 wherein insulation is provided between said covering members.

22. A generally box shaped wall panel construction including in combination a first pair of spaced and generally parallel side frame members each having first and second end portions, each of said side frame members of said first pair having a generally channel shaped cross section, said frame members having three sides and one substantially open end, said open end of each channel shape facing in a first direction, a second pair of spaced and generally parallel side frame members each having first and second end portions, each of said side frame members of said second pair having a generally channel shaped cross section said frame members having three sides and only substantially open end, said open end of each channel shape facing in a second direction opposite said first direction, first and second plates respectively connecting said first and second end portions of said first and second pair of said side frame members in fixed position with respect to each other, each said plate having four corners, each corner being formed into first and second tabs extending generally normal to the plate and generally at a right angle to each other, an end portion of each side frame member residing adjacent said first and second tabs of a corner of a plate, and means extending between a tab and said side of the side frame member to fixedly secure the same together.

23. A generally box shaped wall panel construction including in combination a first pair of spaced and generally parallel side frame members each having first and second end portions, each of said side frame members of said first pair having a generally box shaped cross section with a portion of the box shape facing in a first direction, a second pair of spaced and generally parallel side frame members each having first and second end portions, each of said side frame members of said second pair having a generally box shaped cross section with a portion of the box shape facing in a second direction opposite said first direction, first and second plates respectively connecting said first and second end portions of said first and second pair of said side frame members in fixed position with respect to each other, each said plate having four corners, each corner being formed into first and second tabs extending generally normal to the plate and generally at a right angle to each other, an end portion of each side frame member residing adjacent said first and second tabs of a corner of a plate, and an affixing means connecting a tab and a end portion of said side frame member to fixedly secure the same together, said box shape side members adapted to receive a channel shape of said side frame members of another panel construction so as to hold the two panel constructions together.

24. A wall panel as claimed in claim 23 wherein the second pair of side frame members having a generally box-shaped cross section has one side which is substantially open to receive windows or doors.

* * * * *